United States Patent [19]

Friedman

[11] 4,374,627

[45] Feb. 22, 1983

[54] BINDER FOR PERFORATED SHEETS OR THE LIKE

[76] Inventor: Michael N. Friedman, 7 Harbor Ct., Centerport, N.Y. 11721

[21] Appl. No.: 234,364

[22] Filed: Jan. 13, 1981

[51] Int. Cl.[3] ..... B42F 13/10; B42F 13/18

[52] U.S. Cl. ..... 402/21; 402/80 P

[58] Field of Search ..... 402/21, 19, 20, 80 P, 402/80 R, 34

[56] References Cited

U.S. PATENT DOCUMENTS

| | | | |
|---|---|---|---|
| 2,099,881 | 11/1937 | Emmer | 402/20 |
| 2,116,078 | 5/1938 | Mevi | 402/80 R |
| 2,139,480 | 12/1938 | Young | 402/21 |
| 2,170,260 | 8/1939 | Cruzan | 402/19 |
| 2,202,567 | 5/1940 | Spinner | 402/21 |
| 2,246,702 | 6/1941 | Stewart | 402/20 |
| 2,314,204 | 3/1943 | Fontecilla | 402/20 |
| 2,450,785 | 10/1948 | Emmer | 402/34 |
| 2,617,423 | 11/1952 | Miller | 402/19 |
| 3,180,488 | 4/1965 | Heusmann | 402/19 X |

FOREIGN PATENT DOCUMENTS

| | | | |
|---|---|---|---|
| 358065 | 12/1961 | Switzerland | 402/21 |
| 729537 | 5/1955 | United Kingdom | 402/21 |

*Primary Examiner*—Paul A. Bell

*Attorney, Agent, or Firm*—Bauer & Amer

[57] ABSTRACT

A two part binder for perforated sheets or the like in which a toothed binder member is provided with a constant opening through which sheets are moved for binding engagement with and disengagement from the teeth of the binder member. Another member closes the opening and has tracks for frictional engagement with the sides of the opening to prevent separation of the members in response to the application of the separating force.

21 Claims, 5 Drawing Figures

BINDER FOR PERFORATED SHEETS OR THE LIKE

This invention relates to binders for perforated loose-leaf sheets and the like.

More particularly, the present invention is directed to a binder wherein the teeth or tines of a comb-like member engage in the perforations of sheets or the like to bind them together to hold them assembled, ready for easy removal or disassembly, and also for reinsertion of one or more of the same or different sheets to the binder.

In the past binders of the type to which the present invention relates have included completely closed ring binder members of substantially comb shape as exemplified by the U.S. Pat. No. 2,170,260 to Cruzan and Mervi U.S. Pat. No. 2,116,078.

Such closed binders generally were made of plastic materials of the type disclosed in Emmer U.S. Pat. No. 2,450,785 that have a memory such that when the binder is bent or flexed from its original shape it returns to its original shape after the bending or flexing force is removed. Because of the tendency to remain in their closed condition, it is difficult to add to or remove from the binder perforated sheets and the like and more especially from the teeth or tines of the binder by flexing one tooth at a time without damage to the surrounding walls of the perforations of the sheets.

In recognition of this problem, auxiliary devices have been devised and applied to the binders or vice versa to enlarge the bend or the curvature of the binder teeth to space them from the binder body to produce an opening between the teeth and binder body so that the perforated sheets may be added to or removed from the comb teeth through the space between the teeth and the binder body. Devices of this general type are exemplified in the patent to Miller U.S. Pat. No. 2,617,423.

Other attempts at avoiding damage to the sheets and their perforations and to make it easier to apply the same to the binder teeth is exemplified in the counterrotating interengaging members of Fontecilla U.S. Pat. No. 2,314,204, Emmer U.S. Pat. No. 2,099,881 and Stewart U.S. Pat. No. 2,246,702. Heusmann U.S. Pat. No. 3,180,488 discloses a binder that utilizes a combination of offset grooves and closely interfitting offset interlocking members of close tolerance and high cost.

Broad acceptance and usage of binders of the prior art has been slow in coming because of the problems inherently presented by their complicated and expensive details of construction. To encourage widespread use of binders to which the present invention relates, the same must be inexpensive to manufacture, easy to use with a minimum of mechanical skill and dexterity and readily operated when it is necessary to change, add to or subtract perforated sheets from the binder without damaging the perforations and the sheets and without need for auxiliary devices to perform such binder functions.

To this end, an object of the present invention is to overcome the problems of binders of the prior art to make them more acceptable to the public by providing a relatively simple cooperation between two relatively movable members. The members are substantially smooth and relatively free of obstructing complicated carefully interengaged structures that enable them to be manufactured inexpensively and avoid the need of any skill to operate.

A feature and object of the present invention resides in the simplicity of the unobstructed construction of the present binder that avoids damage to the sheets and their perforations and obviates the need for separate unrelated devices to enable the binder to perform its intended functions.

The above description, as well as further objects, features and advantages of the present invention, will be more fully appreciated by reference to the following detailed description of a presently preferred, but nonetheless illustrative, embodiment in accordance with the present invention when taken in conjunction with the accompanying drawings wherein.

Figure 1:
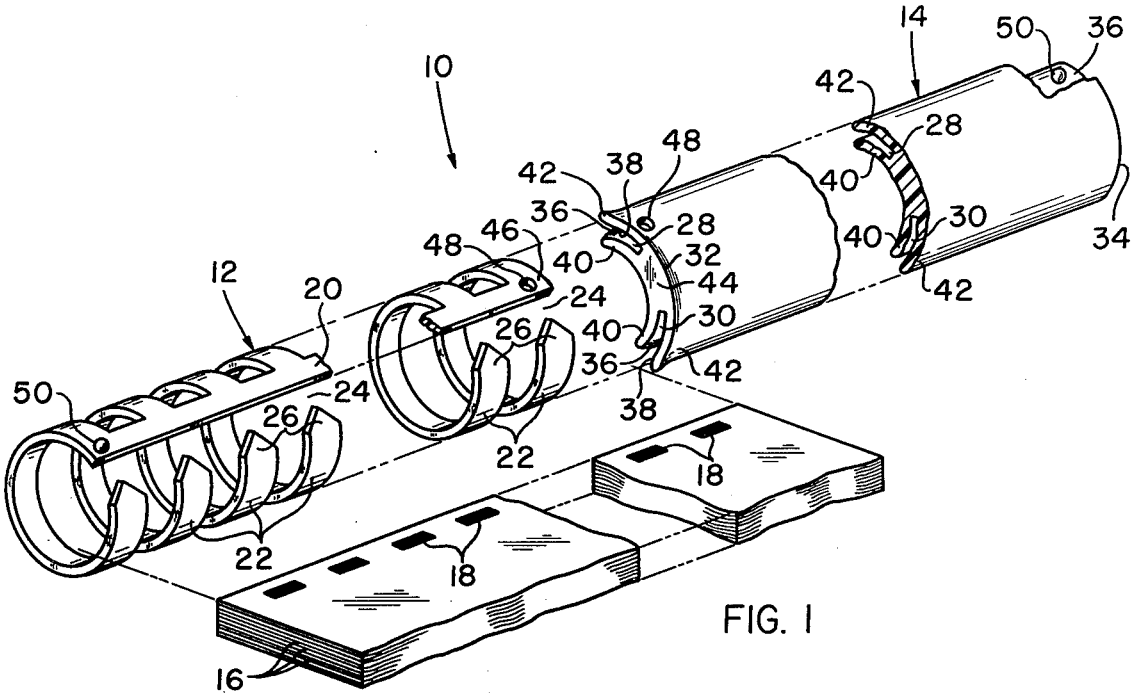
FIG. 1 is an exploded perspective view of the working members of a binder according to the teaching of the invention.
Figure 2:
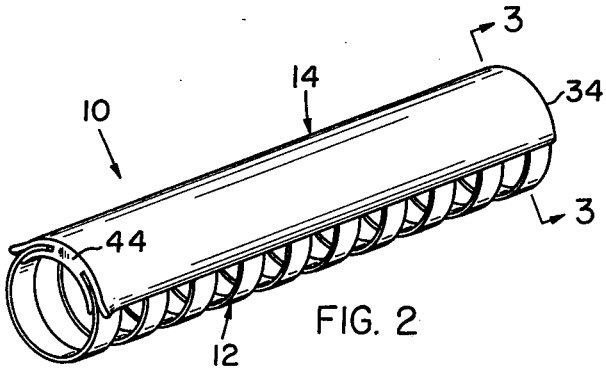
FIG. 2 is a perspective view of the binder of FIG. 1 shown in its assembled closed operative position.
Figure 3:
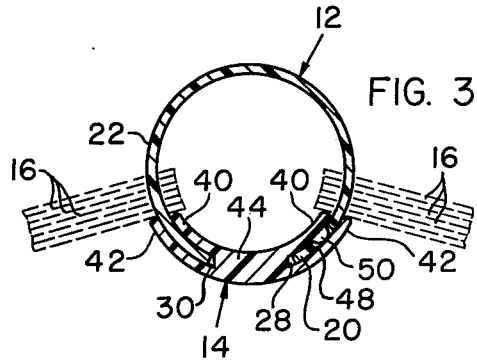
FIG. 3 is a cross section of FIG. 2 taken along lines 3—3 with the assembled binder rotated approximately 180° about its longitudinal axis.

Referring to the drawing, the binder is generally identified by the numeral 10 and is comprised of essentially two separate elongated members generally identified by the numerals 12 and 14, respectively, that are adapted to be moved longitudinally relative to each other from a separated relation as illustrated in FIG. 1 to an assembled binding position as illustrated in FIG. 2. When the binder 10 is in its closed or binding position of FIG. 2, it is adapted to retain a plurality or perforated sheets 16 or the like bound together as shown in FIG. 3. It is to be understood that the present invention is not intended to be limited in its scope by the mere reference to sheets or the like. Rather, it is within the contemplation of the invention that the binder 10 be capable of functioning with any materials other than sheets of any specific configuration bound together at apertures or perforations 18 provided therein.

The one member 12 may be aptly described as the binder member only because it is intended to directly engage with the perforations 18 to retain the sheets 16 bound together. It is formed in the general shape of a comb in that it is provided with a continuous body 20 that is uninterrupted along its elongation or length. The comb or binder member 12 is formed as a singular or unitary sheet that is then die cut or stamped in a most inexpensive manner to produce a plurality of relatively spaced teeth or tines 22. The teeth 22 are shown in the drawing to be spaced for and along the full length of the unitary and integrally formed body 20 while extending in a direction lateral to and away from the body.

Initially the singular comb or binder member 12 may be inexpensively extruded in long indeterminate lengths that are then severed individually to lengths desired for their end uses. Thereafter, the spaces between the teeth 22 may be struck to delineate the desired shape and width of the teeth. When the spaces are struck from the extrusion, the result is the unitary member 12 having the body 20 and the teeth 22 extending from a side thereof. The member 12 may be formed of any one of a number of materials that enable it to be flexed and bent, but also provide it with a memory. That is to say, when any portion of the member is bent or flexed from its formed shape, it returns to its original shape after the deforming force is removed. Materials of this kind are well known. Examples of them are described in at least one of the prior art referred to previously herein.

Although the binder member 12 may be formed initially substantially in an open ring shape as shown, at present it is less expensive to extrude the same in a flat condition and after removing the spaces or material between the teeth 22, fix it with a desired initial bend or curvature throughout its length. The member 12 is bent and curved along the axis of its length so as to cause the teeth 22 and the body 20 to be directed inward toward each other. The bend or curve is deliberately incomplete and left with a longitudinal space 24 between the fingers 22 and the body 20 to provide a constantly open passageway through which the perforated sides of the sheets 16 may be moved and inserted for alignment with the teeth 22. When the perforations 18 of the sheets are aligned with the narrowed pointed V-shaped ends 26 of the teeth 22, the teeth are moved into and through the perforations 18 to bind them to the member 12.

The member 12 will be made of sufficient lengths so as to enable its teeth to engage with all or as many of the perforations 18 as are deemed necessary by the user to perform the binding function. Similarly, the extent of the space 24 may be varied depending upon the thickness and number of the sheets 16 to be inserted and moved thereinto for engagement with the teeth 22 at any given time. The passageway space 24 affords easy, open, unobstructed access for movement of the sheets 16 to and from alignment and engagement with the teeth 22. Because the teeth 22 flex along their lengths, they are readily inserted into the perforations 18 and also are removed therefrom without affecting the integrity of the perforations 18 or the sheets 16 that remain undisturbed and undamaged by the present binder.

The closure member 14 serves to bridge the open space 24 of the member 12 to close the same and to engage and connect the body 20 and teeth 22 together to prevent the unbinding of the perforated sheets 16 therefrom. The member 14 may be made of the same or different material from that of the member 12. In practice it is conveniently and inexpensively formed in a single elongated length by the continuous extrusion of a longer length from which shorter lengths of desired working dimensions may be cut or severed. Because one of the functions of the member 14 is to close, by bridging the gap or space 24, it is preferably made of a length substantially coincident with or longer than that of the member 12. When assembled in their closed binding position, the two members form an attractive completed binder that presents the appearance of unitary singular structure.

Formed within and extending along the opposite elongated sides of the member 14 are slots 28 and 30 respectively that continue for the full lengths thereof, including the leading and trailing ends 32 and 34 respectively. This arrangement of open sided slots 28 and 30 and ends 32 and 34 results naturally when shorter lengths are severed or cut from a continuous extrusion of the member 14 having the slotted sides 28 and 30 provided therein initially. The slots extend into the member 14 from the open sides thereof and are defined by bordering inner and outer surfaces 36 and 38 respectively of relatively spaced inner and outer walls 40 and 42 respectively. The combination of the walls and the defined slots function in the nature of guide tracks along which the body 20 and teeth 22 of the member 12 are tracked and guided to and from the closed binding position as shown in FIG. 2.

Separating the inner defines of the slots 28 and 30 is a connecting wall 44 that serves to retain the walls in their inner and outer spaced relationship and also provides a substantially rigid spine that extends for the full length of the member 14. The spine wall or connection 44 adds rigidity and strength to the member 14 that permits it a limited amount of twist and flex along the longitudinal axis without fracture of the member. The spine connection 44 also serves to add rigidity to the inner and outer walls 40 and 42 such that they retain their relatively spaced relationship so that the space of the slots 28 and 30 also remains substantially fixed. It has been found desirable to make the member 14 of a material that has a memory such that after the removal of a deforming, twisting or flexing force, the same will return to its original shape and configuration. For this reason, it may be extruded or made of the same material as the binder member 12.

The drawing illustrates the member 14 as bent to assume a curve about its axis and continuous throughout its length that approximates and is substantially coincident with that of the member 12. More specifically the contour of the tracks of the member 14 approximates and is substantially coincident with the shape and contour of the respective body 20 and teeth 22 that are received for relative sliding movement therein and guided smoothly and uninterruptedly therealong. To this end the thickness of the body 20 and teeth 22 relative to the space between the relatively spaced inner and outer walls 36 and 38 of their respective tracks is such as to afford surface to surface engagement between them while also permitting smooth unobstructed relative sliding movement of the members 12 and 14. Hence, although the surfaces 36 and 38 of the walls 40 and 42 are in engagement with the corresponding adjacent surfaces of the body 20 and 22, the same also are able to move relative to each other without restraining or restricting binding therebetween.

As shown in FIGS. 1 and 2, the leading end 32 of the member 14 is provided with a flared entrance at each of the slots 28 and 30. This may be accomplished by bending or turning the ends of the walls 36 and/or 38 inward or outward in a direction away from the slot proper to effect an enlargement at the leading ends of each slot. The flared enlargement provides a convenient entranceway into the slots thereby making it easier for the corresponding leading end 46 of the body 20 and for the spaced teeth 22 of the member 12 to be introduced thereinto without critical alignment and careful interfitting of such parts.

Each of the members 12 and 14 is provided with engaging means that function and engage only when the members are properly arranged in their closed binding position. Because it is important that the engaging means not interfere with the introduction of the body 20 and teeth 22 into their respective tracks, both members 12 and 14 are provided with an aperture or hole 48 while both members also are provided with mating projections or detents 50 proximate their trailing ends.

Thus, the aperture 48 is provided in the leading portion of the body 20 while a like opening 48 is provided in the outer wall 42 of the slot 28. An engaging protrusion 50 projects from the inner wall 40 into the slot 28 and into the path of the body 20 to pop into and engage with the hole 48 of the body. Another detent protrusion 50 projects from the outer surface of the body 20 at its trailing portion for locking engagement with the aperture 48 in the wall 42 at the leading end 32 of the slot 28. When the members 12 and 14 are in their closed binding position of FIG. 2, the engagements of the protrusions or detents 50 with their respective holes 48 are sufficient to lock the members 12 and 14 together to resist normal longitudinal separating forces that may be applied to them. However, they will release their restraining engagement and locking relationship in response to a force of a magnitude appllied deliberately to disengage them.

By so arranging the apertures 48 at the leading end portions 46 and 32 of the members 12 and 14 and by positioning the obstructing engaging locking means or protrusions 50 at the trailing portions of the same members, the entrance of the member 12 into the tracks of the member 14 is open and unencumbered. It is only until the members 12 and 14 are finally moved to their closed binding position do the locking means engage. Until then the track slots 28 and 30 are free of the hindrance that the protrusions would produce were one or both of them located at the leading portions of either the body 20 or the tracks 28 or 30.

The operation of the present invention is made extremely simple by reason of the smooth uninterrupted and unobstructed contour of the teeth 22, the body 20 and the tracks 28 and 30. When it is desired to utilize the binder 10, a group of sheets or the like 16 having perforations 18 provided therein are moved in the direction of the passageway 24 between the body 20 and the teeth points 26 until such time as the perforations 18 are aligned with the teeth 22. At that time the binder member 12 may be rotated so as to project the teeth points 26 through the perforations 18 or to move the perforations over the teeth 22, or by a combination of such movements. When the desired number of sheets 16 are applied to the teeth 22, the bridge enclosure member 14 is then positioned such that its guiding tracks, as defined by the slots 28 and 30, are longitudinally aligned with the end 46 of the member 12. The members 12 and 14 are then moved relative to each other until the body 20 and teeth 22 move through the flared end of their respective slotted tracks 28 and 30 at their leading ends 32 and 46.

It is important to note that both the body 20 and the teeth 22, and the surfaces 36 and 38 of each of the respective tracks are relatively smooth, uninterrupted and unobstructed to thereby aid in their quick and simple alignment and guiding motion of the two members 12 and 14 longitudinally relative to each other. The flared ends of each of the tracks of the member 14 enable a smooth entrance and passageway of the body 20 and teeth 22 into their respective tracks until such time as the aperture 48 at the end 46 aligns with the projection 50 at the opposite trailing end 34 of the member 14.

When the two members are aligned in their closed position, the projections 50 will pop or snap into their respective apertures 48. The engagement of such locking means comprising the projections and apertures 50 and 48 respectively locks the two members from relative longitudinal movement in response to an accidental displacing or separating force that may be applied to the same. However, when a deliberate separating force is applied to each of the members 12 and 14 to separate them longitudinally, the projections 50 will move and be displaced in the manner of detents by flexing the surfaces of which they form a part to disengage from their respective holes 48 to permit the members 12 and 14 to be separated.

The simple provision of the cooperating apertures 48 and the detent projections 50 here described should not constitute a limitation upon the scope of the invention. Any other convenient form of locking means may be utilized provided the same are sufficient to restrain and resist relative movement of the members 12 and 14 longitudinally in response to an accidental separating force that may be applied to them. It has been found most convenient to apply the aperture 48 and the projection 50 to the body 20 of the binder member 12 rather than to the teeth 22 since the body 20 has greater substance and rigidity in its cooperation with the respective aperture 48 and projection detent 50 of the bridge enclosure member 14 than do the teeth 22.

Figure 4:
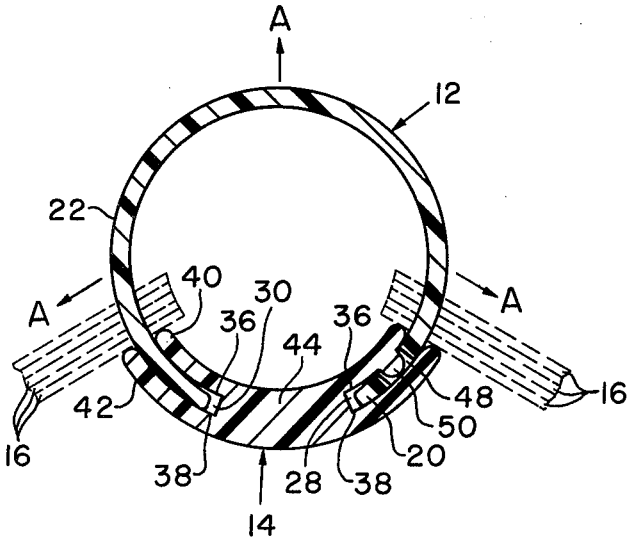
FIG. 4 is a cross section similar to FIG. 3 with a separating force applied to one of the binder members.

When the binder 10 is in its assembled condition as shown in FIG. 2, it will be clear that at least one of the locking detent means 48 and 50 is visible to the user and to provide an indication of when the members 12 and 14 are in their closed position. In such closed position as shown in FIG. 2, the sheets will be held on the binder teeth 22 as is illustrated in the view of FIGS. 3 and 4. When the sheets 16 are open in the manner of a book as illustrated in FIG. 3, they may rest against the inner wall 42 of the member 14. In such resting position the sheets 16 apply a separating force to the teeth 22 in the directions of arrows A as seen in FIG. 4 that tend to move and withdraw the teeth 22 and the body 20 outward from their respective tracks in the direction of the side openings of the slots 30 and 28 respectively.

This outward separating movement as applied to the teeth of the member 12 is resisted in the first instance in the area of the body 20 by the detent engaging means 48 and 50 at the opposite ends of the binder 10. This resistance to the separation of the body 20 from its respective slotted track 28 is further enhanced by the slight outward distortion of the body 20 and the teeth 22 as shown in the exaggerated illustration of FIG. 4 wherein the inner surface of the body 20 is tilted at a slight angle to the inner surface 36 of the wall 40 to wedge and frictionally engage thereagainst. At the same time the outer surface of the body 20 is brought into tight frictional wedging engagement with the inner surface 38 of the wall 42 to create a resistance against the outward movement of the body 20 from its respective slotted track.

The teeth 22 similarly resist the application of any separating force that may be applied to them to remove them from along the length of their respective slotted track 30. Such separating force, when applied to the teeth 22, causes the teeth to tilt and wedge at an angle within their respective slotted track 30 to bring substantially their full inner and outer surfaces into engagement with the respective inner and outer surfaces 36 and 38 of the walls 40 and 42. An exaggerated illustration is shown in FIG. 4 wherein the inner surface of the teeth 22 wedges against the inner surface 36 of the wall 40 while the outer surface of the teeth 22 wedges against the inner surface 38 of the wall 42. The increased frictional resisting force created by this wedging action and the surface to surface engagement between the teeth and the walls 36 and 38 increases with the magnitude of the separating force to oppose the same and restrain the displacement of the body and teeth from their respective tracks.

Thus, the smooth curvature and flexible nature of the body 20 and the teeth 22 causes the same to deform from their original shape into wedging tighter frictional surface engagement with the mating surfaces 36 and 38 which, in the initial relationship of such surfaces prior to the application of the separating force, produces a slight frictional engagement with the corresponding body and teeth surfaces that normally resist a simple application of separating forces to the same. As a consequence, the need for notches, obstructions or offset surfaces at 36 and 38 or at the teeth 22 or the body 20 is obviated. The normal resilience and memory of the member 12 returns the same to its initial curved or bent configuration after the separating force is removed from the member 12.

In the operation of the present invention it has been found that resistance to a separating force that is applied to the member 12 may be controlled by preselecting the depth or extent of relative engagement between the surfaces 36 and 38 of the respective slotted tracks 28 and 30 with the respective body 20 and teeth 22. That is to say, by assuring a sufficient length of surface to surface engagement between the aforementioned surfaces, it is possible to increase the resistance to separation of the body and teeth from their respective tracks in response to an increased separating force that is expected to be applied to the same.

In practice it has been found that where the surfaces 38 of the slotted tracks 28 and 30 have a combined arc of engagement with the body 20 and the teeth 22 of between 90° and 160°, the same is sufficient to resist the forces that might tend to separate the teeth and body from their respective tracks. In most instances, depending upon the diameter of the member 12, it has been preferable to provide a combined arc of surface engagement between the surfaces 38 and the corresponding surfaces of the body 20 and teeth 22 of approximately 150°.

During normal use the indicated surface engagement is sufficient to resist the separation of the member 12 from the member 14. In such cases the length of the surface engagement between the respective tracks 28 and 30 with the body 20 and teeth 22 respectively is substantially equal. However, it will be recognized that the teeth 22 are separated by spaces and, therefore, their total surface engagement with the surfaces 36 and 38 of their respective slotted track 30 is slightly less than the frictional surface engagement that the body 20 makes with its slotted track 28 since the body 20 is continuous and more rigid than the teeth.

Figure 5:
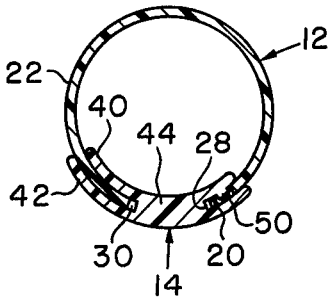
FIG. 5 is a cross section similar to FIG. 3 showing another embodiment.

In light of this, it is possible that the extent of surface engagement between the body 20 and the surfaces 36 and 38 of the slot 28 may be reduced and some of it may be allocated to said in preventing displacement of the teeth 22 from their track 30. This will permit the extent of engagement between the teeth 22 and the surfaces 36 and 38 of the slotted track 30 to be substantially increased. An illustration of this is made in FIG. 5 wherein the slotted track 30 for the guided engagement with the teeth 22 is of substantially greater and unequal length than that of the slotted track 28 and its engagement with the body 20 positioned therewithin.

It has been found that the arcuate extent of the connecting wall 44 should be slightly less than the extent of the passageway space 24 of the member 12. As a consequence, the pointed ends 26 of the teeth 22 will be arcuately spaced slightly from the adjacent inner surface of the wall 44 of its respective slot 30 while the body 20 also will be slightly spaced from the inner edge of the wall 44 in the slotted track 28. This relative space is illustrated more clearly in FIGS. 3, 4 and 5. The space between the teeth 22 and the body 20 from the adjacent surfaces of the wall 44 thereby permits the teeth, the body and the member 12 to move within their respective slots 30 and 28 and relative to the member 14. This relative rotational movement afforded between the members 12 and 14 obviates the possible build up of stress and deteriorating forces that might be applied to the teeth 22 and to the body 20 that would tend to fracture or break the same should such stress exceed the strength and modulus of elasticity of the flexible teeth 22.

While there have been shown and described and pointed out the fundamental novel features of the invention as applied to a preferred embodiment thereof, it will be understood that various omissions and substitutions and changes in the form and details of the device illustrated and in its operation may be made by those skilled in the art without departing from the spirit of the invention. It is the intention, therefore, to be limited only as indicated by the scope of the claims appended hereto.

What is claimed is:

1. A binding comprising a toothed member and an engaging member relatively movable lengthwise to and from a binding position, said toothed member having an elongated body formed unitary with a plurality of teeth extending from one side thereof, said body and teeth being curved about its longitudinal axis so that the free ends of said plurality of teeth are spaced from an adjacent side of said body and said free ends of said teeth and body are substantially smooth and free of obstructions such that perforated sheets and the like may be moved through said space and the free unobstructed ends of said teeth may move unobstructedly through the sheet perforations for engagement with and disengagement from the perforations to bind the sheets and the like to said toothed member, and said engaging member being elongated to substantially the length of said toothed member and having relatively spaced tracks on opposite sides of the length thereof so that each said track engages a respective one of said body and teeth for relative lengthwise sliding engaging movement to and from the binding position, said tracks being substantially smooth and unobstructed and curved substantially coincident with their respective body and teeth to effect surface engagement therewith along said coincident substantially smooth and unobstructed curves such that when a separating force is applied to said toothed member other than in the lengthwise direction, the applied separating force causes said body and teeth to deform out of their original curvature into surface frictional engagement with the surfaces of their respective tracks to resist relative separation of said toothed member from said engaging member in the direction of the separating force.

2. A binding as in claim 1, means on said members releasably engageable when said members are in their binding position to restrain said members from relative movement from the binding position except upon the application of a force sufficient to release the engagement of said engageable means to permit the relative sliding movement of said members from said binding position.

3. A binding as in claim 2,
said plurality of teeth being flexible along their lengths and movable relative to said body from which the same extend,
said tracks of said engaging member being substantially rigid in their curved directions and being defined within and open along opposite lengths and ends of said engaging member for receipt thereinto and to facilitate relative lengthwise guided sliding movement of said toothed member and engaging member through said open end to and from said binding position.

4. A binding as in claim 3,
one of said open ends of said tracks being flared to provide an enlarged entrance for the guided insertion of said toothed member thereinto.

5. A binding as in claim 2,
said tracks having a combined arc of engagement with the surfaces of said body and teeth of between 90° and 160°.

6. A binding as in claim 5,
said combined arc of engagement being approximately 150°.

7. A binding as in claim 1,
the extent of engagement between said body and its respective track being substantially equal to the extent of engagement between said teeth with their respective track.

8. A binding as in claim 1,
the extent of curved engagement between said body and its respective track being different from the extent of engagement between said teeth and their respective track.

9. A binding as in claim 8,
the extent of curved engagement between said teeth and their respective track being greater than that of said body and its respective track.

10. A binding as in claim 1,
said curve of said teeth and body of said toothed member and respective tracks each being substantially smooth and free of interrupting obstructions to enable said members relative rotation about their longitudinal axes and to permit the same to move into tighter and greater frictional surface engagement with each other upon the application of the separating force to said toothed member.

11. A binder for perforated sheets and the like comprising an open substantially ring-shaped binder member having an elongated solid body free of obstructions from which a plurality of teeth are relatively spaced along the length of said body for engaging in the perforations of sheets to be bound thereby, said teeth being flexible along their lengths and substantially smooth and unobstructed,
an elongated closure member having a length and curvature corresponding substantially to that of the open ring-shaped binder member and having relatively spaced walls defining slots that are open along the opposite sides of the length of said closure member,
said walls defining said slots having substantially smooth unobstructed surfaces forming guide tracks that are spaced from each other arcuately in the direction of the curve of said closure member,
said tracks being open at least at one end of said closure member to receive said body and teeth of said binder member for relative sliding movement therein and for partial curved encirclement thereof in and by the radially spaced walls of said respective ones of said slots,
and said flexible teeth of said binding member being deformable and movable relative to said body such that when a separating force is applied to said binder member to displace the same from said slot openings in a direction transverse to the length thereof, said unobstructed teeth and body are caused to deform and move within their respective unobstructed tracks to bring their facing surfaces into greater frictional engagement with the adjacent substantially smooth unobstructed surfaces of said walls to thereby resist relative separation of said members thereat from each other.

12. A binder as in claim 11,
means on each of said members releasably engageable when said members are slidingly moved into a binding position.

13. A binder as in claim 11,
said teeth and body of said open ring-shaped binder member being arcuately spaced from each other to enable the perforations of sheets to be inserted therebetween and for the engagement of said unobstructed teeth in the sheet perforations when the perforations are aligned with said teeth.

14. A binder as in claim 13,
the thickness of said body and teeth approximating that of the space of said spaced walls and being smaller than said space by an amount to permit relative sliding movement between said members without binding engagement therebetween.

15. A binder as in claim 11,
said respective tracks for said body and teeth each being of substantially equal arcuate extent.

16. A binder as in claim 11,
the curved extent of said respective track for said body being less than the extent of said respective track for said teeth.

17. A binder as in claim 13,
the arcuate inner ends of said tracks being spaced from each other less than said arcuate space between said teeth and body to permit relative rotation between said binder member and said closure member.

18. A binder for perforated sheets or the like comprising
a binder member having an elongated body and a plurality of teeth relatively spaced from each other along and extending from one side of the length of said body,
said teeth and body being bent toward each other with the free ends of said teeth and body being substantially smooth and unobstructed and spaced from each other to form an opening through which the sheets to be bound may be moved for binding engagement of the teeth with the perforations and for disengagement therefrom,
a closure member elongated substantially to the length of said body and being of a width greater than the space between said body and teeth to fully bridge and close the space therebetween,
a slot extending into each of the sides of the length of said closure member for receiving a respective one of said body and teeth,
said slots being defined by walls having substantially smooth unobstructed surfaces relatively spaced from each other approximately equal to but greater than the thickness of said body and teeth such as to enable said body and teeth to slide relative to the unobstructed surfaces of said slot defining walls without binding engagement therewith, said slots being open along said sides of said closure member and at least one end thereof to enable said body and teeth to be inserted into their respective slots through said open one end thereof for unobstructed sliding movement of said members relative to each other to a building position, means on said members releasably engageable when said members are in their binding position to retain the same from relative displacement therefrom, and said teeth being flexible along their lengths such that when a separating force is applied to said binding member transverse to the lengths thereof said teeth and body deform and move into surface frictional engagement with the relatively spaced walls of their respective slots to resist relative separation therebetween.

19. A binder as in claim 18, said slots being shaped corresponding to the bend of their respective body and teeth, said slots extending into said engaging member for a distance greater than the extent of their engagement with their respective body and teeth to permit relative movement of said body and teeth within their respective slots without displacement therefrom through the sides of said engaging member.

20. A binder as in claim 19, said bend of said slots, body and teeth being along an arc in which the combined arc of engagement between said body and teeth with the surfaces of said slot defining walls is between 90° and 160°.

21. In a binder for releasably binding perforated sheets and the like by slidably moving two members lengthwise relative to each other to and from a binding position, one of said members having two relatively spaced tracks defined in the length thereof and extending into said member from and opening at and along the sides of the member and at least an end thereof to slidingly receive said other member through said open end and for relative movement lengthwise along said tracks at the open sides thereof, said other member being like a comb having a solid continuous body for movement in and lengthwise relative to one of said tracks and a plurality of perforation engaging tines connected with and relatively spaced along the length of said continuous body for movement in and relative to the other of said tracks, said tracks, body and tines each having two bordering substantially smooth uninterrupted and unobstructed surfaces to permit said relative sliding movement of said members and normal unrestricted movement of said body and tines within their respective tracks relative to and from said open sides, said comb-like member being bent to direct said tines toward said body but spaced therefrom to enable the insertion of perforated sheets and the like through said space to align the perforations with said smooth uninterrupted tines for easy insertion of the tines through the perforations to bind the sheets and the like to said comb-like member and for unhindered and unobstructed easy removal therefrom and to cause said tines and body to deform such that their surfaces are caused to move into frictional engagement with the two respective track surfaces to resist displacement from their respective tracks through the open sides thereof in response to a corresponding separating force applied to said comb-like member in a direction transverse to the length thereof, and means on said members releasably engageable to retain the same in their binding position.

* * * * *